United States Patent [19]

Furuhashi et al.

[11] 4,375,208

[45] Mar. 1, 1983

[54] IDLING SPEED CONTROLLING SYSTEM FOR AN INTERNAL COMBUSTION ENGINE

[75] Inventors: Syoji Furuhashi; Kazuhiro Higashiyama, both of Kanagawa, Japan

[73] Assignee: Nissan Motor Company, Ltd., Yokohama, Japan

[21] Appl. No.: 247,788

[22] Filed: Mar. 26, 1981

[30] Foreign Application Priority Data

Mar. 27, 1980 [JP] Japan ..... 55-38226

[51] Int. Cl.[3] ..... F02D 9/02

[52] U.S. Cl. ..... 123/339; 123/585

[58] Field of Search ..... 123/339, 585

[56] References Cited

U.S. PATENT DOCUMENTS

| | | | |
|---|---|---|---|
| 4,291,656 | 9/1981 | Miyagi et al. | 123/339 X |
| 4,305,360 | 12/1981 | Meyer et al. | 123/339 |

FOREIGN PATENT DOCUMENTS

| | | | |
|---|---|---|---|
| 55-98628 | 7/1980 | Japan | 123/339 |
| 55-148933 | 11/1980 | Japan | 123/339 |
| 55-153834 | 12/1980 | Japan | 123/339 |
| 2035618 | 6/1980 | United Kingdom | 123/339 |
| 2051420 | 1/1981 | United Kingdom . | |

*Primary Examiner*—Tony M. Argenbright

*Attorney, Agent, or Firm*—Schwartz, Jeffery, Schwaab, Mack, Blumenthal & Koch

[57] ABSTRACT

A system for controlling the idling engine speed (output) of an internal combustion engine (controlled device) in an automotive vehicle in either open-loop or feedback control mode is disclosed. In the open-loop control mode, the control operation is based on the cooling water temperature of the engine, in the feedback control mode, the control operation being based on the deviation of an actual engine speed from the reference (input) engine speed. In some conventional systems, there is provided a time delay between the transfer of control from open-loop control to feedback control. However, according to the present invention there is provided a means for supplying instantaneously an additional intake air flow quantity to the engine in addition to the intake air quantity required in the feedback control mode at the instant when the control mode is transferred from the open-loop to feedback control. Consequently, the engine speed gradually settles at the reference engine speed without unfavorable hunting and overshooting so that an engine stalling due to lowered reference engine speed can be prevented.

18 Claims, 20 Drawing Figures

12
30
28
ALPHA LOOK-UP
INV2
FEEDBACK
OPEN
INV3
OR2
AND5
INV1
COMP. 2
38
AND5
34
60
TIMER
AND3
ALPHA SUBTRACT
ALPHA ALU+MEM
56
ALPHA=0
INV4
AND1
N<NREFSIGNAL
AND2
NREFSIGNAL
COMP. 1
36
START
OR1
FEEDBACK CONTROL
FEEDBACK ALU+MEM
50
OPEN-LOOP ALU+MEM
54
ADDER
58
VCM VALVE
16
AAC VALVE
18
FIRST COUNTER
32
SECOND COUNTER
CRANK A SENSOR
20
VEHICLE SPEED SENSOR
24
IDLE SWITCH
22
NEUTRAL SWITCH
26

CONTROL UNIT
OUTPUT SIGNAL
70 %
30 %
65 %
35 %
60 %
40 %
50 %
50 %
40 %
60 %
40 %
30 %
70 %
1/20 sec
1/20 sec
1/20 sec
1/20 sec
1/20 sec
1/20 sec SOLENOID VALVE 16f
OPEN
CLOSE VACUUM PRESSURE
Hi
Lo
INTAKE AIR QUANTITY
Hi
Lo

IDLING SPEED CONTROLLING SYSTEM FOR AN INTERNAL COMBUSTION ENGINE

BACKGROUND OF THE INVENTION

1. Field of the Invention

The present invention relates generally to an electronic control system using a microcomputer for controlling the idling speed of an internal combustion engine, and more specifically to an electronic control system for controlling engine idling speed in either an open-loop or feedback control mode according to the engine operating condition by adjusting the degree of opening of an auxiliary air control valve (referred hereinafter simply as AAC valve) continuously so as to provide an appropriate intake air flow quantity for the engine.

2. Description of the Prior Art

In recent years, electronic control systems using microcomputers have been applied to automotive vehicle for appropriately controlling the fuel injection rate, ignition spark timing, exhaust gas recirculation, etc. of internal combustion engines.

Since the present invention relates to a system for controlling engine idling speed among other things, a prior art system will now be briefly described.

The systems generally comprises: (a) a control unit, (b) vacuum control modulator valve (referred simply to as VCM valve), and (c) an AAC valve.

The control unit controls an air mixture fuel supplied to the engine, according to input signals from a throttle valve (hereinafter referred to as idle switch) which turns on when the throttle valve is in the idling state, a crank angle sensor, a temperature sensor which senses the temperature of cooling water, a vehicle speed sensor, etc.

The VCM valve controls a vacuum pressure applied to the AAC valve according to an output pulse signal with a duty ratio obtained from the control unit.

The AAC valve controls the intake air flow quantity of an auxiliary air passage according to the controlled vacuum pressure from the VCM valve.

The control unit described above, when providing automatic control over a controlled result, e.g., the number of engine revolutions, detects the conditions under which the engine is being operated to determine whether it should perform feedback control or open-loop control, according to input signals indicating the engine load condition such as a throttle switch, vehicle speed sensor, neutral switch of a transmission gear or crank angle sensor.

Depending on the result of this determination, the control unit outputs a pulse signal, after a predetermined processing of arithmetic operations for obtaining the proper duty ratio for the pulse signal.

In the feedback control mode, the deviation of the actual number of engine revolutions per time (engine speed), measured by the crank angle sensor, from a predetermined number of engine revolutions (reference input) is obtained. If the deviation exceeds a predetermined zone (dead zone), a duty ratio of pulse signal to be fed to the VCM valve is adjusted so as to introduce the instaneous (or actual) number of engine revolutions (engine speed) within the predetermined zone (dead zone). Consequently, the VCM valve actuates the AAC valve to open an amount to provide an appropriate intake air flow quantity to maintain the instantaneous number of engine revolutions within the predetermined zone.

The repetitions of such cycle in the feedback control mode are performed so that the instantaneous number of engine idling revolutions (controlled variable: engine speed) settles within the predetermined zone. On the other hand, in the open-loop control mode, a numerical value stored in a memory of the control unit is read out to provide the duty ratio of the output pulse signal according to the engine operating condition, e.g., a cooling water temperature for the engine. The control unit can roughly be divided into two circuits: a control mode determining circuit and arithmetic and logic operation/memory circuit.

In operation, the control unit checks to see whether the idle switch is turned on or not. If the idle switch is turned off, the control unit executes open-loop control. If the idle switch is turned on, the control unit further checks to see whether the instantaneous number of engine revolutions obtained from the crank angle sensor is below the predetermined zone (dead zone: the minimum limit may be the reference input value minus 25 rpm). If the engine speed is below the reference value, the control unit performs feedback control immediately in the next step. If engine speed is above a reference value, the control unit checks to see whether the elapsed time from the time when the throttle valve switch is turned on is more than 4 sec. If it is found not more than 4 sec., the control unit continues open-loop control. If it is found more than 4 sec., the control unit advances to the next step where the control unit checks to see whether the elapsed time from the time when the neutral switch of the transmission gear is turned on is more than 1 sec. If it is more than 1 sec., the control unit switches and execute the feedback control. If it is not more than 1 sec., the control unit checks to see whether the elapsed time from the time when the vehicle speed decreases and arrives at 8 Km/h is more than 1 sec. If it is found not more than 1 sec., the control unit continues open-loop control. If it is found more than 1 sec., the control unit switches and executes the feedback control.

In such a conventional system for controlling the engine idling speed the fixed time delay described above is provided to start the actual feedback control. Therefore, when engine conditions indicate feedback control operation, actual feedback control may be started earlier than desired if the engine idling speed is excessively high with respect to the predetermined zone (dead zone) even after elapsing the fixed delay time at the time when the idle switch is turned on with the transmission gear in the neutral position. Consequently, an undershooting of the output engine speed occurs and the engine idling speed may drop abruptly and even cause engine stalling in a worst case.

In addition, the engine idling speed may generally be set at a lower range to improve fuel consumption savings. However, as the engine idling speed is reduced, the stability of the engine (controlled device) will be reduced in proportion thereto. For this reason, if the engine idling speed is set lower, when an abrupt change of the intake air flow quantity (manipulated variable of controlled device) occurs at the instant when control is transferred from open-loop to feedback control the engine speed will not settle smoothly to a predetermined speed since the controlled variable and manipulated variable are not in a steady state. Consequently, an unfavorable hunting or engine stalling may occur due to the abrupt speed drop in the predetermined engine idling speed.

SUMMARY OF THE INVENTION

In respect of the above-described problem, it is an object of the present invention to provide an electronic control system for controlling the idling speed of an internal combustion engine of an automotive vehicle to eliminate engine hunting or stalling which occur due to abrupt changes in the intake air flow quantity at the instant when control is transferred from open-loop to feedback control in the case where the reference idling speed is set low or in the case where the actual engine speed is considerably higher than the reference engine speed.

According to the present invention, there is provided an idling speed control system for an internal combustion engine of an automotive vehicle such that the intake air flow quantity determined on the basis of the deviation of an actual engine speed from a reference engine speed is additionally supplied to the combustion chamber of the engine through the actuation of an AAC valve. Thereby the engine speed gradually drops and settles within a predetermined zone near the reference engine speed. The addition of extra intake air is performed only at the instant when the control mode is transferred from the open-loop control mode to the feedback control mode.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The features and advantages of the present invention will be better appreciated from the following drawings, wherein like reference numerals designate corresponding elements and in which:

FIGS. 6*b* through 6*h* are characteristic graphs of basic and corrective duty ratios stored in each ALU+-MEM circuit of the idling speed control system of the preferred embodiment shown in FIG. 5;

DETAILED DESCRIPTION OF THE PREFERRED EMBODIMENTS

Reference will be made to the drawings and first to FIG. 1*a* which illustrates chiefly an engine idling speed control system and construction of an internal combustion engine of an automotive vehicle.

Figure 1A:
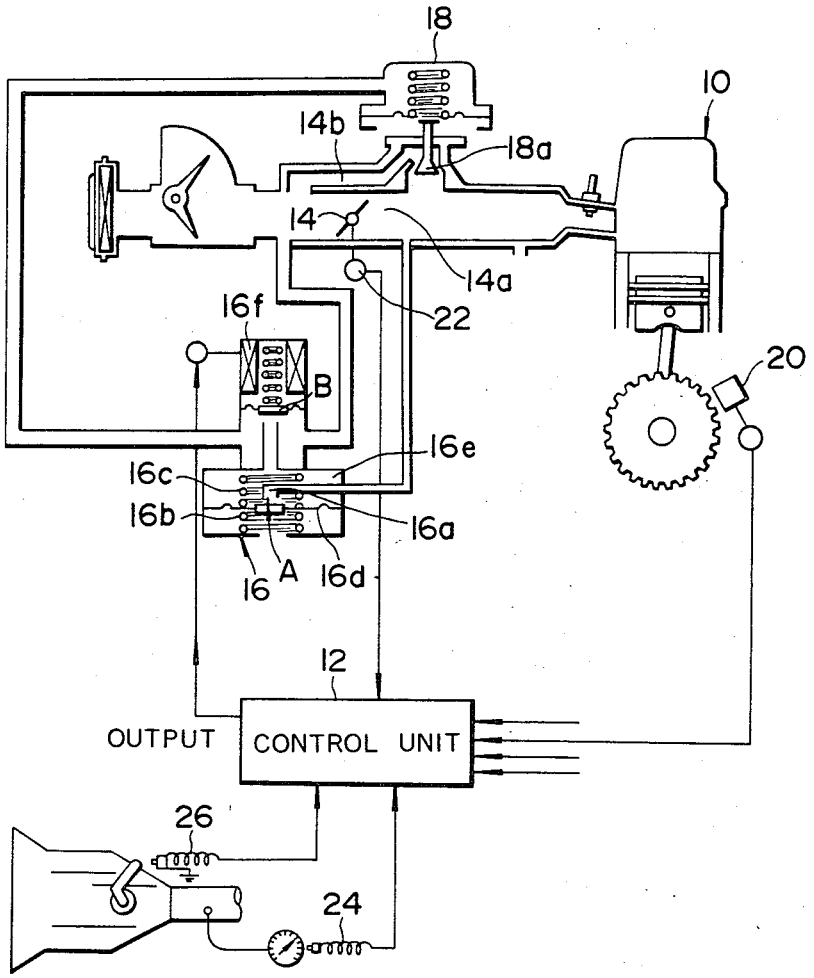
FIG. 1*a* is a schematic overall drawing of an electronic concentrated engine control system, particularly illustrating an idling speed control system applied to an internal combustion engine of an automotive vehicle.

In FIG. 1*a,* numeral 10 denotes an internal combustion engine (hereinafter engine), numeral 12 denotes a control unit using a microcomputer for concentratedly controlling an amount of injected fuel to the engine 10, intake air flow quantity, etc., numeral 14 denotes a throttle valve located in a throttle chamber 14*a* of an intake air passage for adjusting a quantity of intake air flowing therethrough, numeral 16 denotes the VCM valve for creating a vacuum pressure according to a pulse signal of a constant amplitude and frequency, its duty ratio being obtained from the control unit 12, numeral 18 denotes the AAC valve for adjusting an intake air flow quantity of an auxiliary air passage 14*b* provided beside the throttle chamber 14*a* according to the vacuum pressure created from the VCM valve 16, numeral 20 denotes a crank angle sensor which comprises three heads around each of which a coil is wound and waveform shaping ciruit (not shown in detail by FIG. 1). Two of the three heads and waveform shaping circuit provided at the next stage produce a first pulse train: one pulse of the first pulse train indicates that a signal disk plate, provided at a crankshaft and having a tooth every 4° on the circumferencial surface thereof, has rotated one degree of rotation angle. Thereafter, the first pulse train is counted and used for a digital signal, the numerical value representing the actual engine speed. Numeral 22 denotes a throttle valve switch (hereinafter referred to as an idle switch) interlocked with the throttle valve 14. The idle switch 22 detects and signals that the throttle valve 14 is in an idling position (the throttle valve 14 can be said to be fully closed in this case). Numeral 24 denotes a vehicle speed sensor which detects and signals the speed of automotive vehicle, in which such system is mounted, by outputting a second pulse train whose number of pulses are proportional to the speed thereof. Numeral 26 denotes a neutral switch (hereinafter referred to as N switch) which detects and signals that a shift gear of a transmission is positioned at the neutral range (referred simply to as N range). Furthermore, the control unit 12 detects mainly an operating condition of the engine 10 on a basis of input signals from the idle switch 22, the vehicle speed sensor 24, neutral switch 26, and crank angle sensor 20, etc. and determines whether the number of engine revolutions per time (engine speed) should be controlled in either of the feedback control mode or open-loop control mode.

Figure 1B:
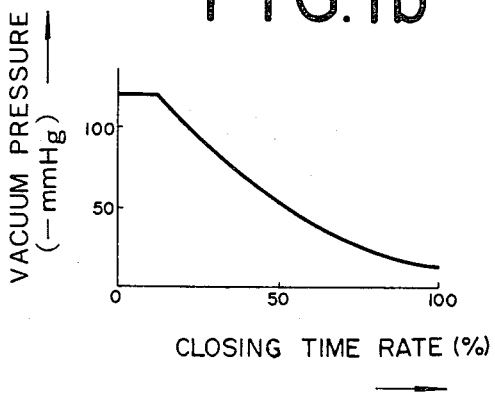
FIG. 1*b* is a characteristic graph of a controlled vacuum pressure created at a vacuum control modulator valve (VCM valve) to be applied to an auxiliary air control valve (AAC valve) with respect to the pulse duty ratio (solenoid valve closing rate) shown in FIG. 1*a;*

The construction and operation of the VCM valve 16 and AAC valve 18 will be described in more detail as follows:

The VCM valve 16, as shown in FIG. 1, includes a first pipe 16*a*, connected to the throttle chamber 14*a*, for introducing an intake manifold vacuum pressure, first and second springs 16*b* and 16*c*, a diaphragm 16*d* one surface thereof being exposed to the atomospheric air, a vacuum pressure chamber 16*e*, and a solenoid valve portion 16*f*. When the engine 10 revolves, a manifold vacuum pressure develops and the pressure causes the diaphragm 16*d* to move to close the first pipe 16*a*. According to engine operating conditions, the manifold vacuum pressure varies so that the combination of the first and second springs 16*b* and 16*c* causes point A of the first pipe 16*a* to close when the manifold vacuum pressure indicates, e.g., −120 mmHg. Therefore, the vacuum pressure chamber 16*e* can be maintained constantly at −120 mmHg even if the manifold vacuum pressure becomes negatively higher and exceeds −120 mmHg. If an output signal from the control unit 22 is fed to the solenoid valve portion 16*f*, a point B is repetitively opened or closed according to the duty ratio of the pulse signal to create a controlled vacuum pressure of −15 to −120 mmHg by mixing the vacuum of −120 mmHg with the air introduced from the upstream of the throttle valve 14. A characteristic curve of the controlled vacuum pressure is shown in FIG. 1*b*.

On the other hand, the AAC valve 18 has a valve 18*a*, located within the auxiliary air passage 14*b*, pulled upward so as to close fully the auxiliary air passage 14*b* when the vacuum pressure from the VCM valve 16 indicates −120 mmHg. When the controlled vacuum pressure below −120 mmHg is applied, the value 18*a* is moved downward so as to open the auxiliary air passage 14*b*. The details on the cooperation of the VCM valve 16 with AAC valve 18 will be further described later. The control unit 12 outputs an on-off pulse signal after performing arithmetic operations determined depending on the control mode. In other words, in the feedback control mode, the control unit 12 calculates a numerical value of the number of engine revolutions per time (engine speed in rpm) from the pulse train of the crank angle sensor 20 and obtains a numerical result representing a deviation of the numerical value of the numbers of engine revolutions per time obtained by the crank angle sensor 20 from a predetermined number of engine revolutions per time (reference engine speed) stored in a memory. If the numerical result exceeds a predetermined range, the duty ratio of the on-off pulse signal outputted therefrom to the VCM valve 16 is adjusted so that the AAC valve 18 operates to adjust instantaneously the intake air flow quantity. Consequently, the number of engine rotations per time (engine speed) is settled with a damping into a predetermined range.

On the other hand, in the open-loop control mode, the control unit 12 outputs the on-off pulse signal with a duty ratio determined by a numerical value stored in a memory on a basis of an engine operating condition so that the intake air flowing through the AAC valve 18 is adjusted to a predetermined value.

Figure 2:
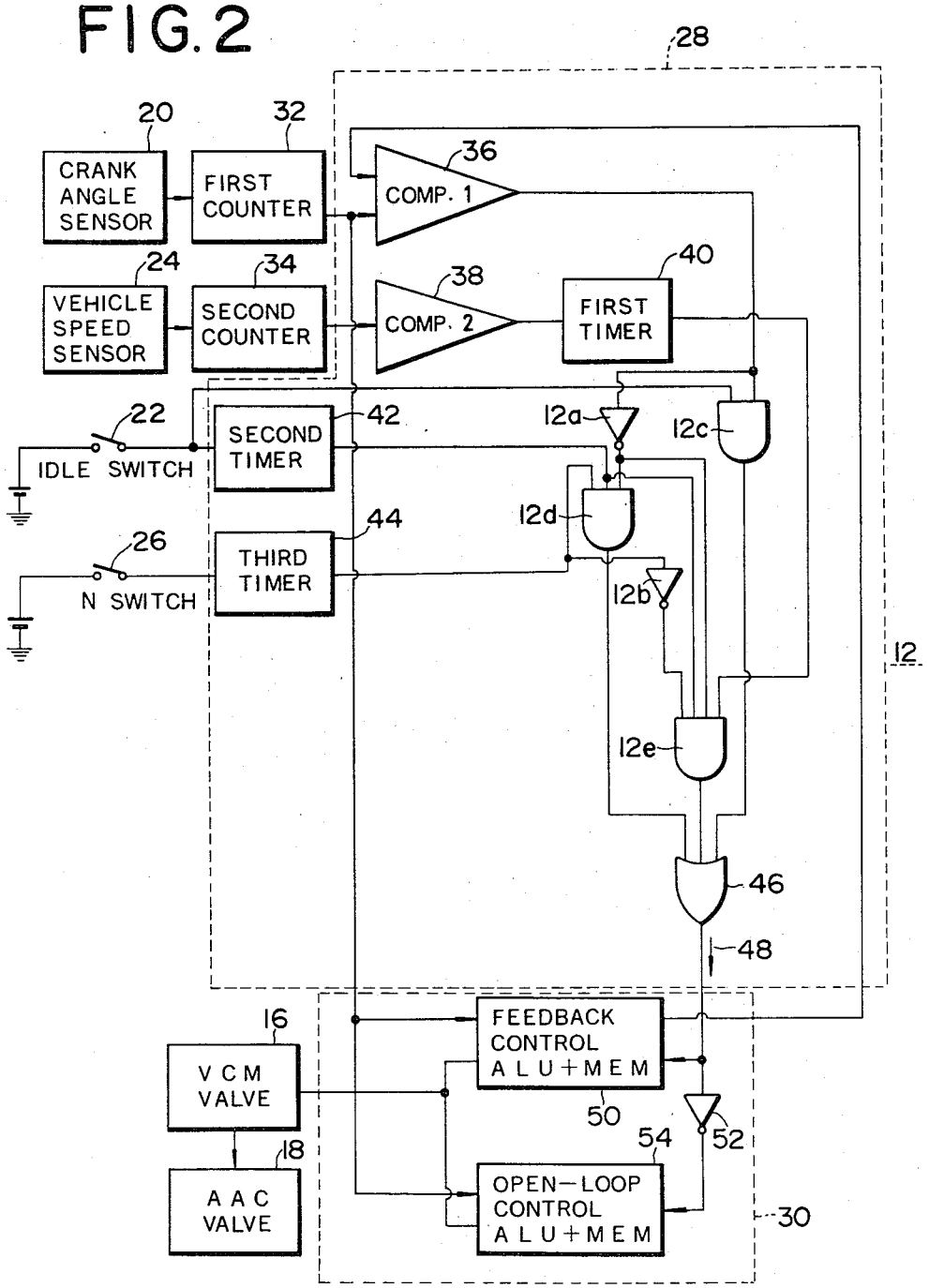
FIG. 2 is a schematic block diagram of a conventional idling speed control system in the construction shown in FIG. 1*a;*

FIG. 2 shows a functional block diagram of a conventional idling speed control system wherein the same reference numerals denote the corresponding elements shown in FIG. 1*a*.

As shown in FIG. 2, the control unit 12 may roughly be divided into two circuits enclosed by dotted lines: a control condition determinating circuit 28 and arithmetic and logic operation/memory circuit 30. In FIG. 2, numeral 32 denotes a first counter whereby a first pulse train outputted from the crank angle sensor 20 is converted into a numerical value representing the number of engine revolutions per time (rpm) in digital fashion and numeral 34 denotes a second counter whereby a second pulse train from the vehicle speed sensor 24 is converted into a numerical value representing an actual speed of the vehicle in a unit of kilometers per hour in digital fashion.

Figure 3:
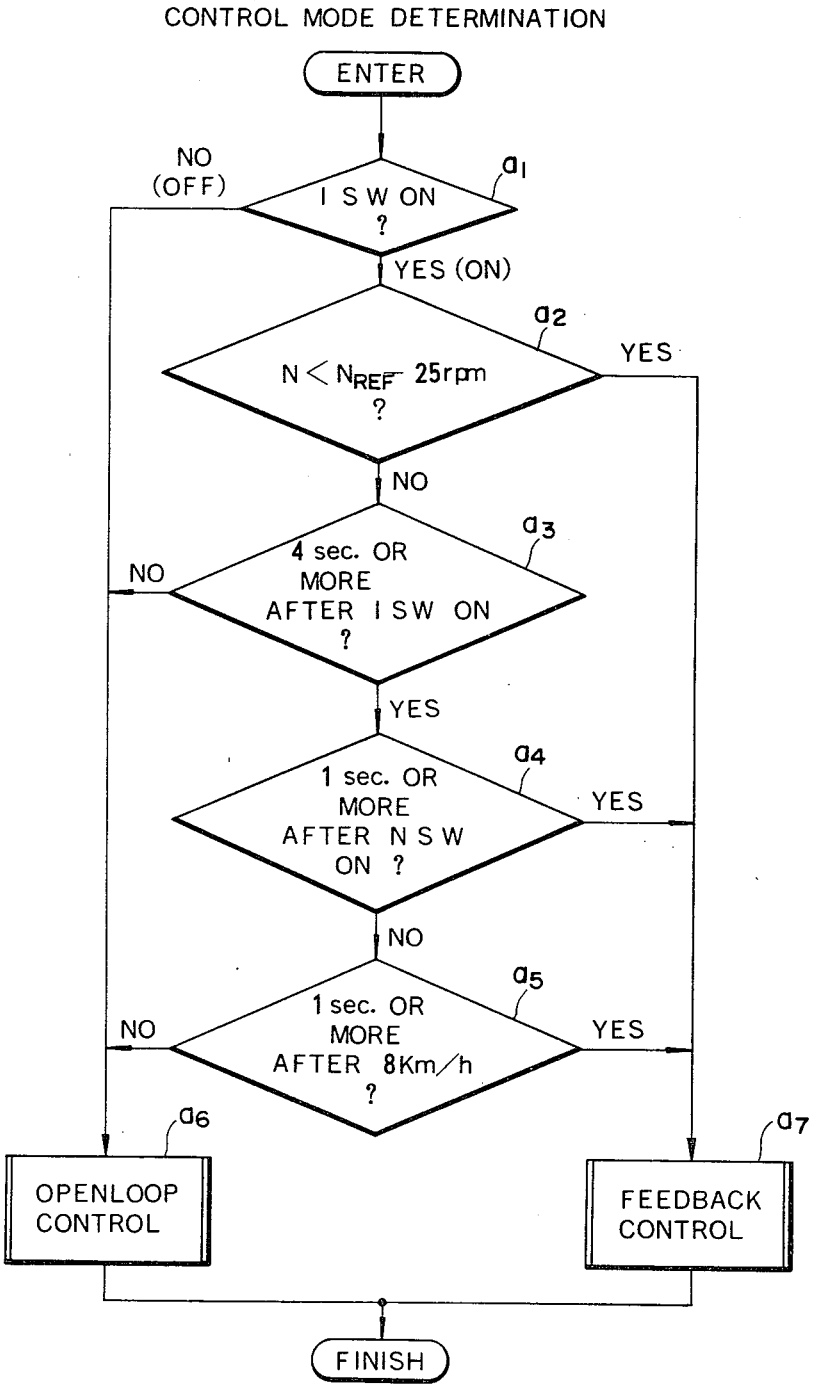
FIG. 3 is a control mode determination sequence flowchart of the conventional idling speed control system shown in FIG. 2.

It will be seen that the idling speed control system uses a positive logic. The operation of the control unit 12 is described hereinafter with reference to the sequence flowchart of FIG. 3. The control mode determining circuit 28 first in step $a_1$ checks to see if the engine 10 is in the idling state according to the position of the idle switch 22 (ON or OFF).

If the idle switch 22 is determined to be turned off in step $a_1$, the open-loop control is carried out in step $a_6$. On the other hand, if the idle switch 22 is turned on, the control mode determining circuit 28 in step $a_2$ checks to see if the output engine idling speed (N) is currently lower than a predetermined value ($N_{REF}-25$ rpm, where $N_{REF}$ denotes the engine speed of reference input). If the answer is yes in the step $a_2$, the feedback control is immediately carried out in step $a_7$. If the answer is no in the step $a_2$, the control determining circuit 28 in step $a_3$ checks to see if the present time is a time 4 seconds or more elapsed from the time when the idle switch 22 is turned on. If the time has not elapsed 4 seconds in the step $a_3$, the control determining circuit 28 outputs a signal to command the open-loop control in the step $a_6$. If the time has elapsed 4 second in the step $a_3$, the control determining circuit 28 in step $a_4$ checks to see if the present time is a time 1 second or more elapsed from the time when the N switch 26 is turned on. If the present time has elapsed 1 second in the step $a_4$, the control determining circuit 28 outputs a command signal to execute the feedback control in the step $a_7$. If the present time has not elapsed 1 second in the step $a_4$, the control determining circuit 28 in step $a_5$ checks to see if the present time is a time 1 second elapsed from the time when the vehicle speed drops and passes below 8 Km/h. If the present time has not elapsed 1 second in the step $a_5$, the control determining circuit 28 outputs a command signal to continue the open-loop control in the step $a_6$. Conversely, if the present time has elapsed 1 second in the step $a_5$, the control determining circuit 28 outputs a command signal to execute the feedback control.

In summary, the feedback control should be carried out if the following conditions are satisfied during the idle operation of the engine 10:

(1) $N<N_{REF}-25$ rpm→UNCONDITIONAL FEEDBACK CONTROL (2) IF $N\geqq N_{REF}-25$ rpm→FEEDBACK CONTROL PROVIDED AT LEAST 4 SECOND DELAY AFTER IDLE SWITCH IS TURNED ON AND THAT AT LEAST 1 SECOND DELAY

AFTER THE N SWITCH IS TURNED ON, OR THE VEHICLE SPEED DROPS BELOW 8 KM/H

Furthermore, as shown in FIG. 2, the control determining circuit 28 of the control unit 12 comprises the following elements: a first digital comparator 36; connected to the first counter 32 and a FEEDBACK CONTROL ALU+MEM circuit 50 (hereinafter ALU denotes arithmetic and logical operation unit and MEM denotes memory unit), which compares the engine speed (N) with the reference engine speed ($N_{REF}$) subtracted by 25 rpm ($N_{REF}-25$ rpm) and outputs a high-level (H) signal when the engine speed N is less than $N_{REF}-25$; a second digital comparator 38, connected to the second counter 34, which compares a numerical value representing the measured vehicle speed with a fixed 8 Km/h representative value and outputs a high-level (H) signal when the measured vehicle speed is below 8 Km/h; a first timer 40, connected to the second digital comparator 38, which outputs a high-level (H) signal after at least one second delay from the time when the vehicle speed is below 8 Km/h; a second timer 42, connected to the idle switch 22, which outputs a high-level (H) signal after at least four second delay from the time when the idle switch 22 is turned on, and; a third timer 44, connected to the N switch 26, which outputs a high-level (H) signal after at least one second delay from the tine when the N switch 26 is turned on. 12*a* and 12*b* denote inverters and 12*c* through 12*e* denote AND gate. The details of logic circuit in the control determining circuit 28 is not described in detail since it is self-explanatory when viewed in conjunction with FIG. 3. An output signal 48 from an OR gate 46 in FIG. 2 serves as an arithmetic operation control signal to be sent to the ALU+MEM circuit 30. When the arithmetic operation control signal 48 becomes high level (H), a FEEDBACK CONTROL ALU+MEM circuit 50 is actuated. Conversely, when the arithmetic operation control signal 48 becomes low level (L), an OPEN-LOOP CONTROL ALU+MEM circuit 54 is actuated since an inverter 52 changes the level of the arithmetic operation control signal 48. The output terminals of the FEEDBACK and OPEN-LOOP CONTROL ALU+MEM circuits 50 and 54 are connected to the VCM valve 16.

When control is transferred from the open-loop mode to the feedback mode, in such a conventional engine idling speed control system, a fixed time delay is provided to start the actual feedback control. For this reason, when one of the conditions to execute the feedback control is satisfied, e.g., the transmission gear is in the N range with the idle switch 26 in the on state, the actual engine speed (N) after the fixed time delay often indicates a considerably high value so that the actual feedback control is started earlier than desired. Consequently, overshooting of control occurs, i.e., the engine speed drops abruptly and passes far away from the reference engine speed ($N_{REF}$) to a very low speed. In a worst case, the engine stalling sometimes occurs.

Figure 4A:
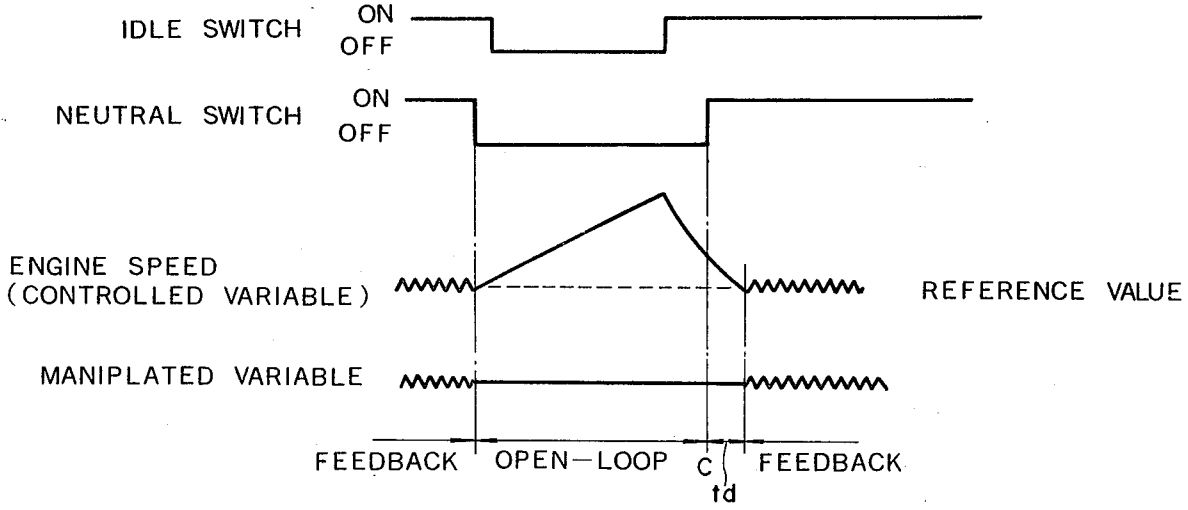
FIGS. 4*a* and 4*b* are timing charts depicting the relationship between engine speed (controlled variable), reference engine speed (reference input), and intake air quantity (manipulated variable) to illustrate the control operation when the control mode is transferred from open-loop to feedback in the conventional idling speed control system shown in FIG. 2.
Figure 4B:
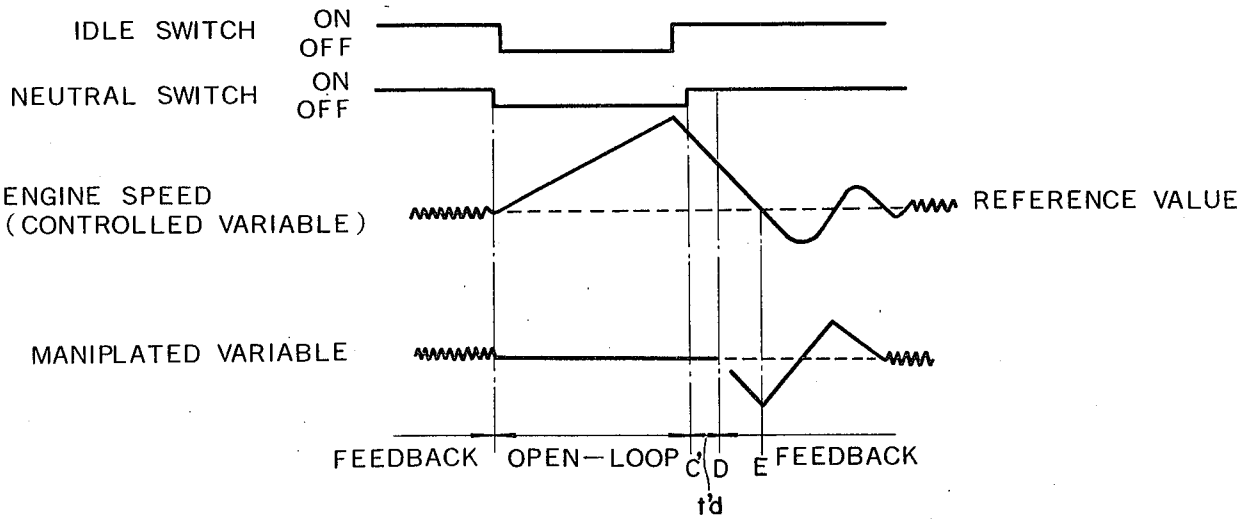

The aforementioned problem will be clearly understood referring to FIGS. 4*a* and 4*b*.

As shown in FIG. 4*a*, when idling speed control is about to transfer from open-loop to feedback control modes, i.e., when the N switch 26 is turned on with the idle switch 22 turned on in this case (in point C of this drawing), the engine speed (controlled variable) drops and arrives near the reference engine speed value (reference input) after the fixed time delay td, so that the idling speed control is smoothly transferred to the feedback control mode in this case.

However, as shown in FIG. 4*b*, when the idling speed control is about to transfer to the feedback mode at a point C', the engine speed at the point C' is considerably higher than the reference engine speed value and the engine speed at a point D after the fixed time delay $t'_d$ is still higher than the reference engine speed value ($N_{REF}$). Therefore, during the interval between the point D and a point E indicating the instant when the speed arrives at the reference engine speed value ($N_{REF}$), the gradient of engine speed deviation is considerably large and a subsequent undershooting of the engine speed (output or controlled variable: N) develops so that unfavorable hunting of the actual engine speed occurs immediately after the transfer to actual feedback control as well as a manipulated variable (intake air flow quantity of the engine).

In addition, the recent trend is to set the reference idling speed lower to improve fuel economy; the lower the reference idling speed the less stable the output engine speed. Therefore, when the reference engine speed ($N_{REF}$) is set lower, an abrupt change of the manipulated variable (intake air quantity) may occur when the control mode transfers from the open-loop control to the feedback control. At this time, even if the manipulated variable (intake air flow quantity) is appropriate for the steady state, the controlled variable (engine speed) of the controlled system (engine) does not settle smoothly at the reference idling speed ($N_{REF}$). Consequently, unfavorable hunting or engine stalling may occur.

With the aforementioned problem with regard to such transient phenomenon in mind, according to the present invention, at the instant when the transfer to the feedback control mode from the open-loop control mode, if the actual engine speed is high compared with the reference engine speed, the VCM valve 16 does not yet come under feedback control and is controlled so that the opening degree of the valve 18*a* of the AAC valve 18 gradually decreases. Therefore, the intake air flow rate reduces gradually so that the output engine speed N comes smoothly near the reference engine speed ($N_{REF}$) and thereafter actual feedback control is effected. Therefore, the above-described problem is solved.

Described hereinafter is a preferred embodiment of the present invention with reference to FIGS. 5 to 8*b*, wherein the same reference numerals denote corresponding elements shown in FIGS. 1*a* through 4*b*.

Figure 5:
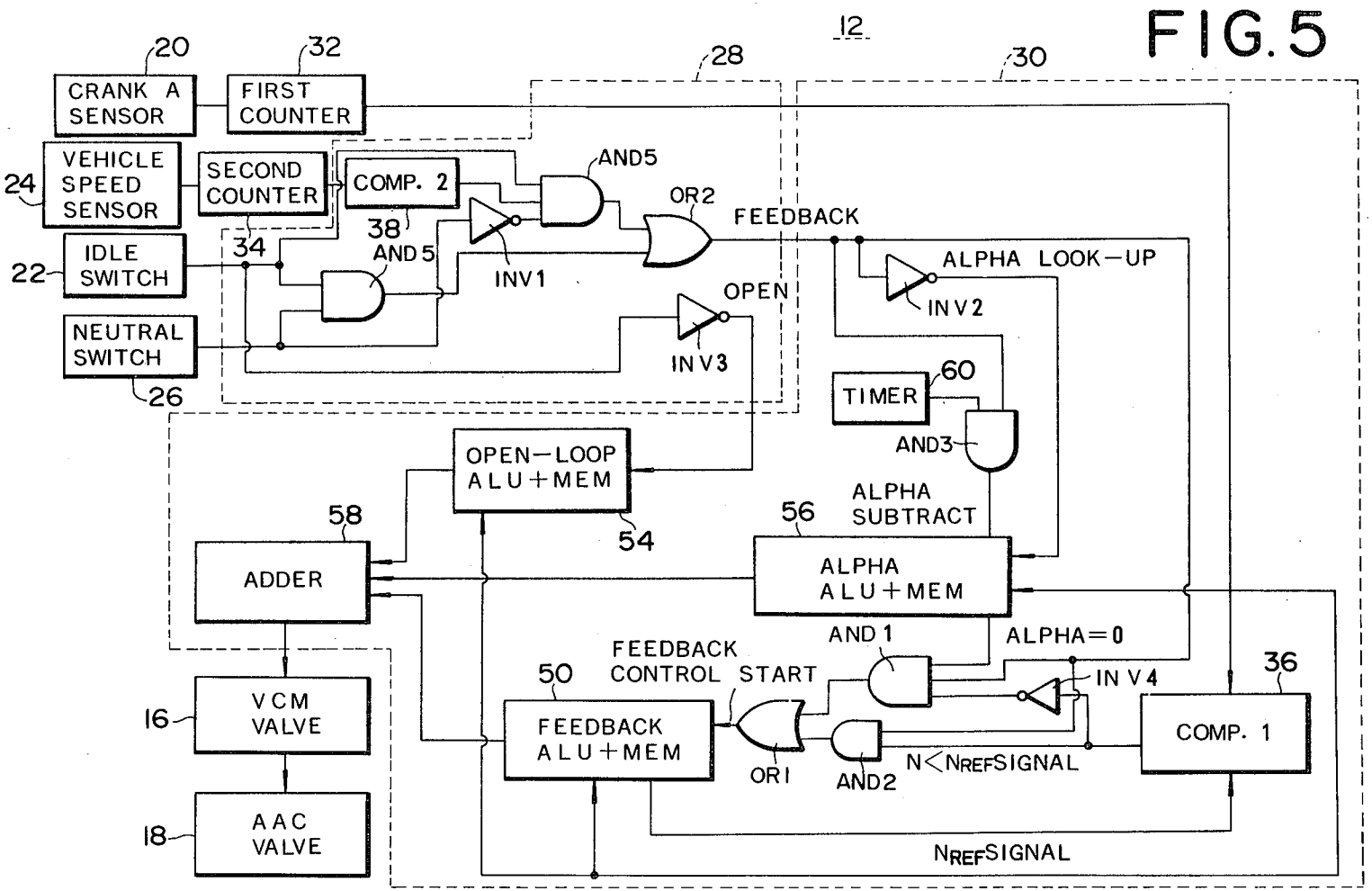
FIG. 5 is a functional block diagram of an idling speed control system of a preferred embodiment according to the present invention.
Figure 6A:
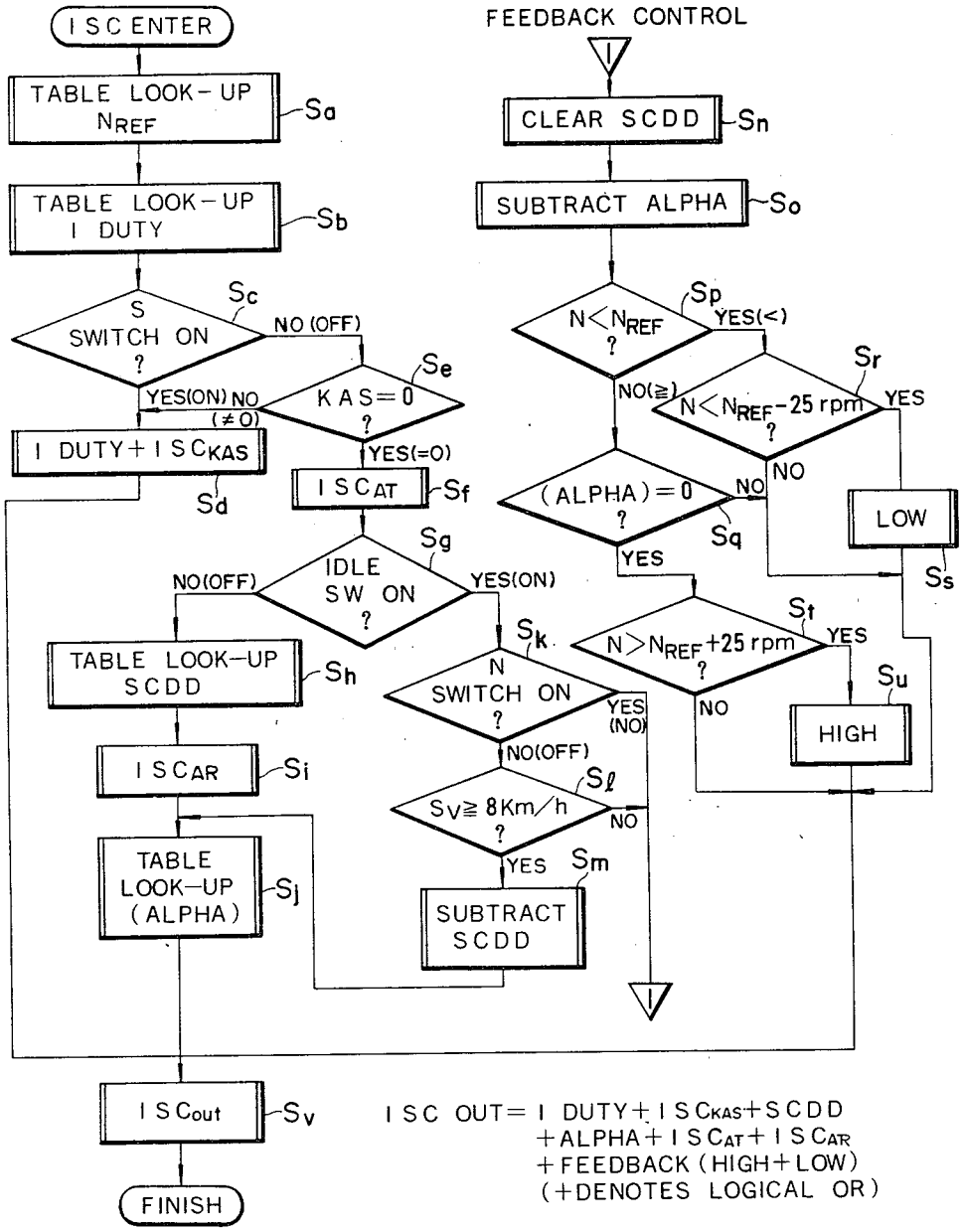
FIG. 6*a* is a detailed processing flowchart of a control unit of an idling speed control system of the preferred embodiment shown in FIG. 5.
Figure 6E:
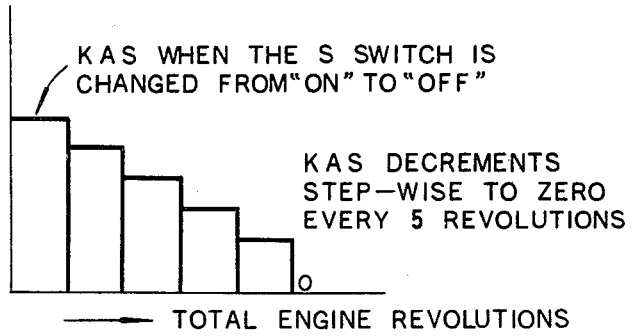

FIG. 5 illustrates a functional block diagram of the idling speed control system of the preferred embodiment according to the present invention. FIG. 6*a* illustrates a detailed processing flowchart of the control unit 12.

It will be appreciated from FIG. 5 that the chief difference from the conventional control unit is the addition of an ALPHA ALU+MEM circuit 56, adder 58 and timer 60 and elimination of the first, second and third timers 40, 42 and 44.

The ALPHA ALU+MEM circuit 56 stores a corrective duty ratio ALPHA to be combined with a basic duty ratio obtained by the OPEN-LOOP ALU+MEM circuit 54, where ALPHA denotes a value looked up from a memory table in the ALPHA ALU+MEM circuit 56, the looked-up value corresponding to an additional amount of the intake air flowing through the auxiliary air passage 14*b* to the engine 10 at the instant when the control mode is transferred from the open-loop control to the feedback control.

The adder 58 outputs a pulse signal, a duty ratio representing an arithmetic operation result from the OPEN-LOOP, ALPHA, and FEEDBACK ALU+-MEM circuits 54, 56 and 50. The timer 60 outputs a regular pulse for the ALPHA subtracting operation to synchronize the subtracting operation with the time determined by the regular pulse.

The OPEN-LOOP ALU+MEM circuit 54 outputs a numerical value representing the duty ratio of the pulse signal to be inputted into the adder 58, e.g., according to the engine speed from the engine speed counter (first counter) 32. With the OPEN signal absent from an inverter $INV_3$, the OPEN-LOOP ALU+MEM circuit 54 is maintained in the pended state, a numerical result, calculated at the last time before the OPEN signal from the inverter $INV_3$ is turned to a low level, being latched. The ALPHA ALU+MEM circuit 56 outputs a value (ALPHA) looked-up from a table in its memory based on the actual engine speed from the first counter 32 while receiving an ALPHA LOOK-UP signal from an inverter $INV_2$. After the ALPHA LOOK-UP signal has turned low (inactive), the ALPHA ALU+MEM circuit 56 outputs the gradually decreasing value (ALPHA) at a certain interval.

The FEEDBACK ALU+MEM circuit 50 outputs a value calculated on a basis of the actual engine speed and reference engine speed while receiving a FEEDBACK CONTROL START signal from an OR gate OR1. The adder 58 outputs a signal representing the addition of numerical results from: OPEN-LOOP ALU+MEM circuit 54, ALPHA ALU+MEM circuit 56, and FEEDBACK ALU+MEM circuit 50.

When the N switch 26 is turned on with the idle switch 22 turned on or the vehicle speed indicates not more than 8 Km/h with the idle switch 22 turned on and the N switch 26 turned off, the transient operation to the feedback control is carried out in two stages:

(1) First stage; Since the ALPHA LOOK-UP signal does not come the ALPHA ALU+MEM circuit 56 receives an AND output from an AND gate AND3 (ALPHA SUBTRACT) of pulses from the timer 60 and FEEDBACK signals, the ALPHA ALU+MEM circuit 56 issues a numerical value of the corrective duty ratio ALPHA, the corrective duty ratio ALPHA indicating such a differential form as decreasing stepwise to zero. Its initial value is obtained on a basis of the actual engine speed as shown by a characteristic curve in FIG. *6g*. Since the timer 60 outputs a pulse for a fixed interval of time, an ALPHA SUBTRACT signal is fed into the ALPHA ALU+MEM circuit 56 when the FEEDBACK signal is issued. Whenever the ALPHA SUBTRACT signal is outputted, the ALPHA stored in the ALPHA ALU+MEM circuit 56 is decreased. When ALPHA=0, the ALPHA ALU+MEM circuit 56 issues an ALPHA=0 representative signal to an AND gate AND1. The reference engine speed ($N_{REF}$) is sent to the first digital comparator 36 from the FEEDBACK ALU+MEM circuit 50. When the actual engine speed N<the reference engine speed $N_{REF}$, the first comparator 36 outputs a $N<N_{REF}$ representative signal to the FEEDBACK ALM+MEM circuit 50. The AND gate AND 1 outputs the FEEDBACK CONTROL START signal when the following signals are received: ALPHA=0; $N \geqq N_{REF}$ (enabled by an inverter INV 4); and FEEDBACK. In other words, while $N \geqq N_{REF}$, the output of adder 58 is gradually subtracted until ALPHA=0 and thereafter the feedback control mode begins in response to the FEEDBACK CONTROL START signal from the AND gate AND 1.

(2) Second stage; When $N<N_{REF}$, the FEEDBACK CONTROL START signal is issued from the OR gate OR1, since the OR gate OR1 receives an AND signal from an AND gate AND2 opened by $N<N_{REF}$ signal and FEEDBACK signal, even if ALPHA≠0. The FEEDBACK ALU+MEM circuit 50 compares the actual engine speed N with the reference engine speed $N_{REF}$ when the FEEDBACK CONTROL START signal is received. If $N<N_{REF}$, the output numerical value of the adder 58 is gradually increased. If $N \geqq N_{REF}$, the output numerical value of the adder 38 is gradually reduced (having a dead zone $N_{REF} \pm 25$ rpm).

If the FEEDBACK CONTROL START signal is turned off, the FEEDBACK ALU+MEM circuit 50 outputs a numerical value of a corrective duty ratio obtained immediately before the FEEDBACK CONTROL START signal is turned off.

In the active state of FEEDBACK signal, the adder 58 outputs the added value from the OPEN-LOOP ALU+MEM circuit 54, ALPHA ALU+MEM circuit 56, and FEEDBACK ALU+MEM circuit 50.

Described hereinafter is a detailed operation sequence of the control unit of an idling speed control system according to the present invention with reference to FIG. *6a*, illustrating a detailed flowchart of engine speed control operation.

In step $S_a$, the control unit 12 searches a first table of the memory for the reference engine speed $N_{REF}$ in the FEEDBACK ALU+MEM circuit 50 ($N_{REF}$ table look up). This table can be appreciated in such a characteristic graph as shown by FIG. *6b*. In step $S_b$, the control unit 12 searches a second table for a basic duty ratio (IDUTY) representing a pulse duty ratio at the time of engine start (IDUTY table look up). A characteristic graph of IDUTY is shown by FIG. *6c*. In step $S_c$, the control unit 12 checks to see if a starter motor switch (S switch, not illustrated) is transferred from "ON" position to "OFF" position. In "ON" position of the starter switch in step $S_c$, the control unit 12 advances to step $S_d$ where IDUTY is corrected so as to be instantaneously increased and thereafter decreased by a corrective duty ratio $ISC_{KAS}$ corresponding to an AFTER START increment KAS. The KAS means an incremental correction coefficient required for an additional amount of injected fuel at the time of cranking, start, and after start. The duty ratio $ISC_{KAS}$ corresponds to 16% of the KAS. The characteristic graph of KAS is shown by FIGS. *6d* and *6e*. To eliminate an unstable state of the engine speed immediately after starting of the engine 10, the idling speed at this time is increased by a acceleration corresponding to the duty ratio of KAS so that the transfer from the cranking to engine starting is smoothly performed. The numerical result of $IDUTY=IDUTY+ISC_{KAS}$ in the step $S_d$ is outputted as $ISC_{out}=IDUTY+ISC_{KAS}$ via step $S_v$. If the starter switch (S switch) is not in "ON" position, a determination of whether the AFTER START increment KAS for the additional amount of injected fuel is zero in step $S_e$. This is because the AFTER START increment (KAS) is decreased stepwise to zero after a fixed interval of engine revolutions, for example, every five engine revolutions. If the After START INCREMENT (KAS)≠0, the control unit 12 advances to the sequence of the step $S_e$, $S_d$ and $S_v$ in the open-loop control mode.

If the AFTER START increment (KAS)=0 in the step $S_e$, the control unit 12 advances to step $S_f$. In the step $S_f$, obtained is another corrective duty ratio $ISC_{AT}$ which is predetermined whether an air conditioner mounted in the automotive vehicle is being operated or not in either an automatic transmission (abbreviated as A/T) equipped vehicle or manual transmission (abbreviated as M/T) equipped vehicle. The duty ratio of $ISC_{AT}$ is listed below.

| Transmission | Air Conditioner | N switch | $ISC_{AT}$ (%) |
|---|---|---|---|
| M/T | OFF | — | 0 |
| | ON | — | 5 |
| A/T | OFF | ON | 0 |
| | | OFF | 1.5 |
| | ON | ON | 9 |
| | | OFF | 10.5 |

Figure 6F:
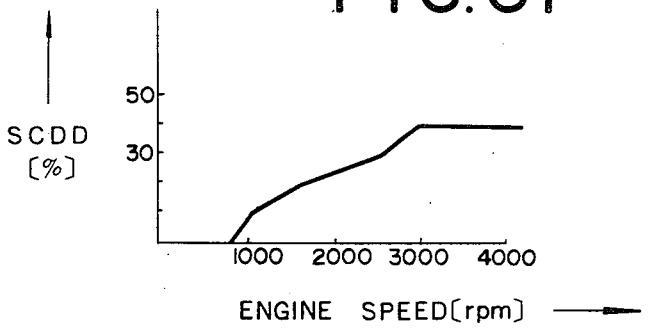

In step $S_g$, the control unit 12 checks to see if the idle switch 22 is turned on or off. If the idle switch 22 is turned off, the control unit 12 advances to step $S_h$ where another corrective duty ratio SCDD, predetermined according to the engine speed is obtained. The duty ratio of SCDD can be appreciated by a characteristic graph as shown by FIG. 6*f*. After the step $S_h$, the control unit 12 advances to step $S_i$ where another corrective duty ratio $ISC_{AR}$ is obtained, which is predetermined according to an opening degree of an air regulator located between the intake air passage 14*a* and intake manifold branch (not shown in FIG. 1), for further increasing intake air flow quantity required for warm-up engine driving when the ambient temperature of the engine is low, through a pipe passing through the air regulator. The air regulator gradually closes the pipe as the engine warms up.

Figure 6G:
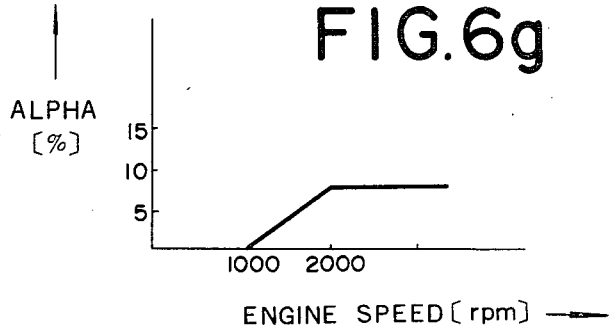

After the step $S_i$, the control unit 12 searches a third table for the numerical value ALPHA which is determined on a basis of the current engine speed in step $S_j$. The characteristic graph of ALPHA is shown in FIG. 6*g*.

After the step $S_j$, the control unit 12 outputs a numerical result of the pulse duty ratio represented by $IDUTY+ISC_{AT}+SCDD+ISC_{AR}+ALPHA$.

On the other hand, if the idle switch 22 is determined to be turned on in the step $S_g$, the control unit 12 advances to step $S_r$ where the neutral (N) switch 26 is checked to see if it is turned on or off. If the N switch 26 is turned off, the control unit 12 advances to step $S_l$ where it is determined if if the vehicle speed sensor 24 indicates whether the vehicle speed $S_v$ is equal to or more than 8 Km/h or below 8 Km/h.

When the vehicle speed $S_v$ is 8 Km/h or higher in step $S_l$, the duty ratio of SCDD is decreased stepwise as shown by FIG. 6*f* in step $S_m$. After the step $S_m$, the control unit 12 advances to the step $S_v$ through the step $S_j$.

If the N switch 26 is turned on in step $S_r$, or if the vehicle speed $S_v$ is not more than 8 Km/h with the N switch turned off in step $S_l$, the control unit 12 advances to the feedback control routine denoted by a triangle 1 in FIG. 6*a*.

In operation of the feedback control routine, the control unit 12 advances to step $S_n$ where the corrective duty ratio SCDD is cleared to zero and thereafter to step $S_o$ where the duty ratio represented by $IDUTY+ISC_{AT}+ISC_{AR}+ALPHA$ is subtracted progressively by a certain value.

After the step $S_o$, the control unit 12 checks to see if the engine speed at the present time N is lower than the reference engine speed $N_{REF}$ in step $S_p$. If the answer is no ($N \geqq N_{REF}$), the control unit 12 in step $S_q$ checks to see if the numerical value of ALPHA is zero.

If ALPHA=0 in the step $S_q$, the control unit 12 checks to see if the actual engine speed N is higher than the dead zone, i.e., the reference value of $N_{REF}$ added by 25 rpm ($N>N_{REF}+25$ rpm), in step $S_t$. If $N \leqq N_{REF}+25$ rpm, in other words, the acutal engine speed N is within the dead zone ($N_{REF}+25$ rpm), and if the ALPHA does not indicate zero in the step $S_q$ (ALPHA$\neq$0), the duty ratio represented by $IDUTY+ISC_{AT}+ISC_{AR}+ALPHA$ is outputted via the step $S_v$.

If the engine speed at the present time N is above $N_{REF}+25$ rpm in step $S_t$, a feedback control correction HIGH (subtraction by a predetermined amount for the intake air flow quantity from the duty ratio obtained in the preceeding steps in order to decrease the intake air quantity) is carried out in step $S_u$.

Figure 6H:
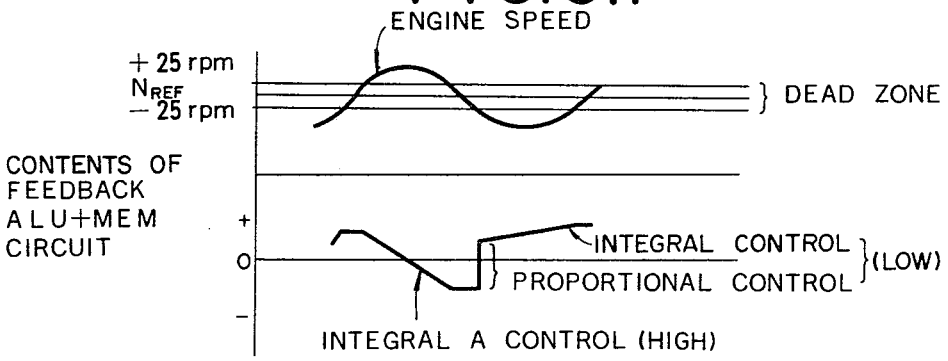
Figure 6E:
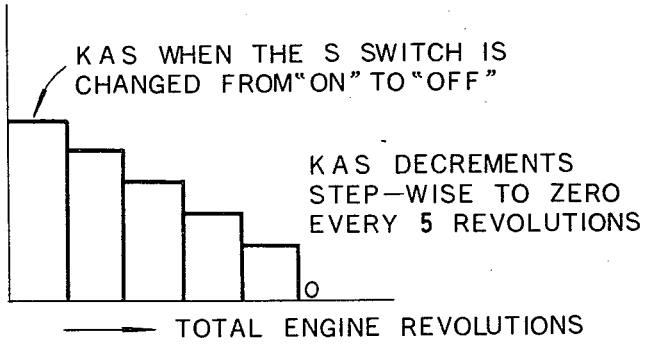
Figure 6F:
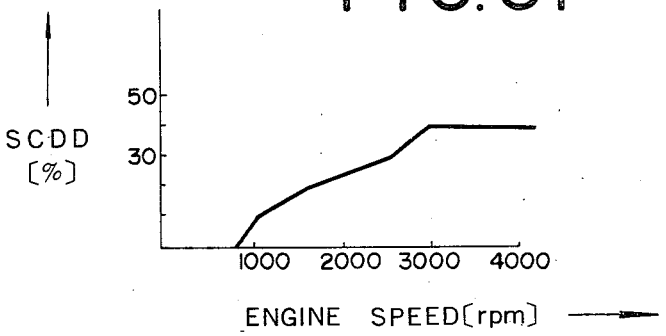
Figure 6G:
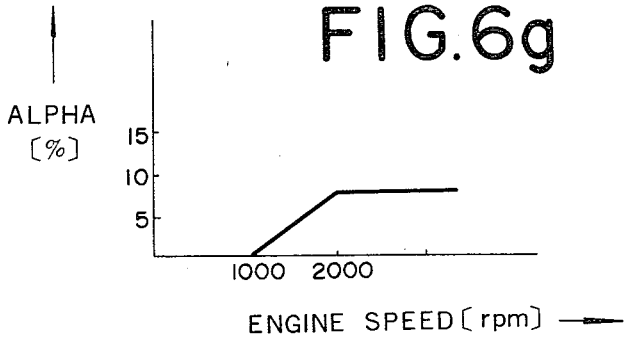
Figure 6H:
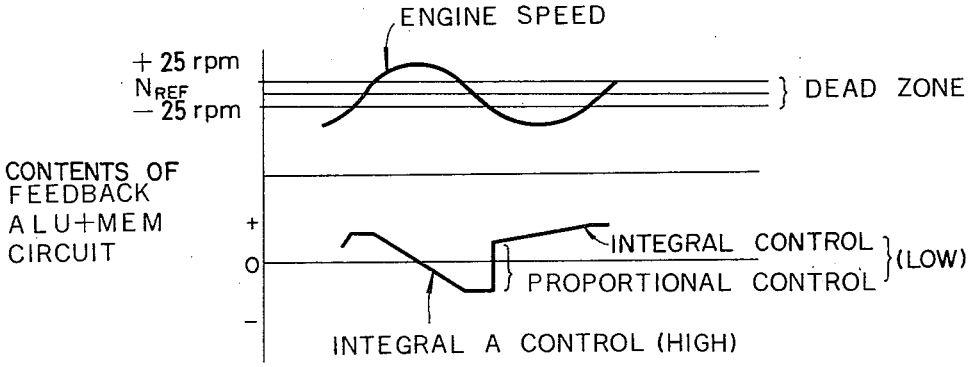

If the engine speed at the present time N does not exceed the dead zone $N_{REF}+25$ rpm ($N \leqq N_{REF}+25$ rmp) in the step $S_t$ or ALPHA is not zero in the step $S_a$, the control unit 12 advances to the step $S_v$ directly as discribed above. A characteristic graph of corrective duty ratio {FEEDBACK(HIGH and LOW)} in the FEEDBACK ALU+MEM circuit 50 is shown in FIG. 6*h*.

Furthermore, if $N<N_{REF}$ in the step $S_p$, the control unit 12 advances to step $S_r$ to check to see if the engine speed N is lower than another dead zone, i.e., the reference engine speed value subtracted by 25 rpm ($N<N_{REF}-25$ rpm).

If $N<N_{REF}-25$ rpm in the step $S_r$, a feedback correction LOW is carried out in step $S_s$. This feedback correction LOW is a corrective duty ratio to add a predetermined value to the duty ratio obtained in the preceeding steps in order to increase the intake air quantity stepwise. If $N \geqq N_{REF}-25$ rpm in the step $S_r$, the control unit 12 advances to the step $S_v$ without the feedback correction LOW in the same way as in the negative result of the step $S_q$ (ALPHA$\neq$0).

Therefore, the output $ISC_{out}$ of arithmetic result from the step $S_v$ may be expressed totally as:

$ISC_{out}=IDUTY+ISC_{KAS}+SCDD+ALPHA+ISC_{AT}+ISC_{AR}+FEEDBACK(HIGH\ or\ LOW)$, where + donates logical OR.

Figures 7A, 7B, 7C:
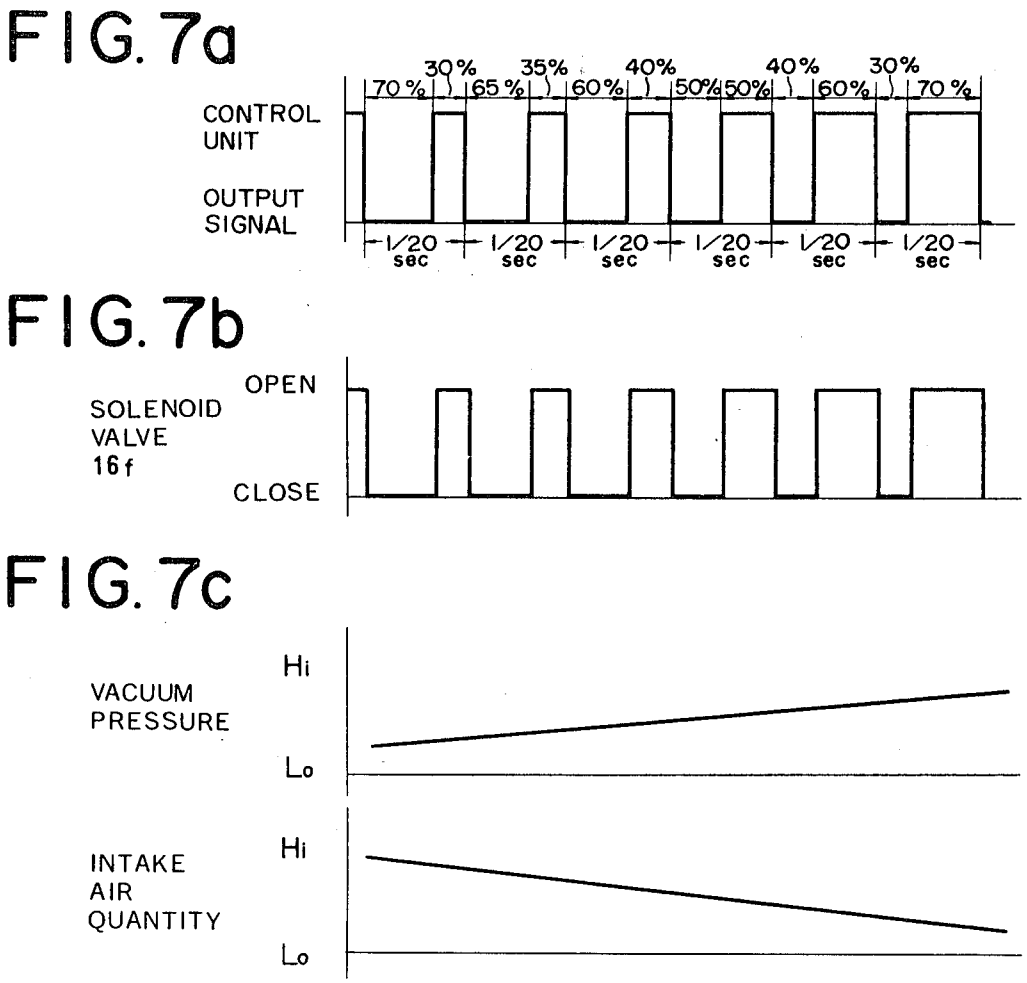
FIGS. 7*a* through 7*c* are examples of a output pulse signal having a duty ratio determined by the control unit of the idling speed control system.

As described hereinbefore, the output pulse signal of the adder 58 having the duty ratio ($ISC_{out}$) obtained in the control unit 12 is sent to actuate the solenoid valve 16*f* of the VCM valve 16 after conversion to a pulse signal. The output pulse signal which is obtained on a basis of the duty ratio ($ISC_{out}$) and the duty ratio representing "OFF" period to one cycle, which, corresponding to the duty ratio, has a frequency of approximately 20 Hertz (51.2 ms of time interval) with a constant amplitude as shown in FIG. 7*a*. The solenoid valve 16*f* of the VCM valve 16 is repetitively opened or closed in synchronization with the output pulse signal, the duty ratio being expressed in a unit of percentage. This percentage represents the rate of OFF state of the pulse signal with respect to the time.

Therefore, if the duty ratio ($ISC_{out}$) is, e.g., 60%, the "OFF" state and "ON" state of the VCM valve 16 is 60% and 40% in respectively the time interval of 1/20 seconds, as shown in FIG. 7*b*.

For example, if the reference engine speed $N_{REF}$ is 650 rpm and the actual engine speed indicates 700 rpm, the control unit 12 performs the feedback control and outputs the ON-OFF pulse signal having a duty ratio determined by the control unit itself 12 into the solenoid valve 16*f* of the VCM valve 16 so as to reduce the actual engine speed to the reference speed $N_{REF}$. At this time, the AAC valve 18 needs to pull upward so as to close the auxiliary air passage 14*b* in FIG. 1*a*. In other words, the controlled vacuum pressure to be applied to the AAC valve 18 needs to become greater negatively toward −120 mmHg.

Therefore, the solenoid valve 16*f* of the VCM valve 16 is actuated so that the opening rate with respect to time is increased (the closing time rate is reduced) to make the controlled vacuum pressure negatively greater. At this time, the introduction of vacuum from the chamber 16*e* is increased.

For example, if the current duty ratio indicates 70%, i.e., the ratio "OFF" state of the output signal is 70%, the closing time rate of the VCM valve 16 is caused to reduce gradually in such a way as 70%, 60%, 50%, 40% and 30%. Consequently, the opening degree of the AAC valve 18*a* gradually decreases and therefore the engine speed is gradually reduced. Such a operation as described above is illustrated in FIG. 7*c*.

Figure 8A:
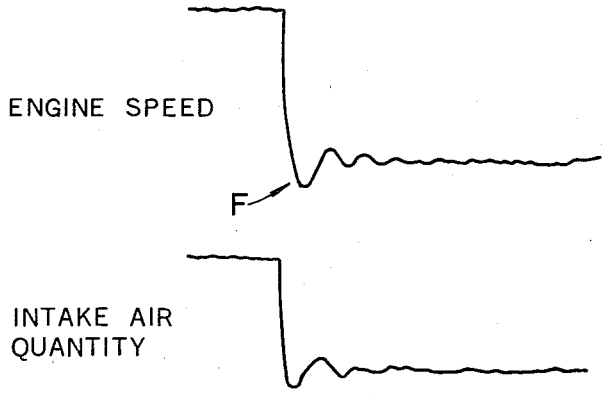
FIGS. 8*a* and 8*b* show the relationship between a controlled variable (engine speed) and a manipulated variable (intake air flow quantity) of a controlled device (internal combustion engine) for illustrating the changing situation of the engine speed when controlled by the conventional idling speed control system and by the preferred embodiment of the present invention, respectively.
Figure 8B:
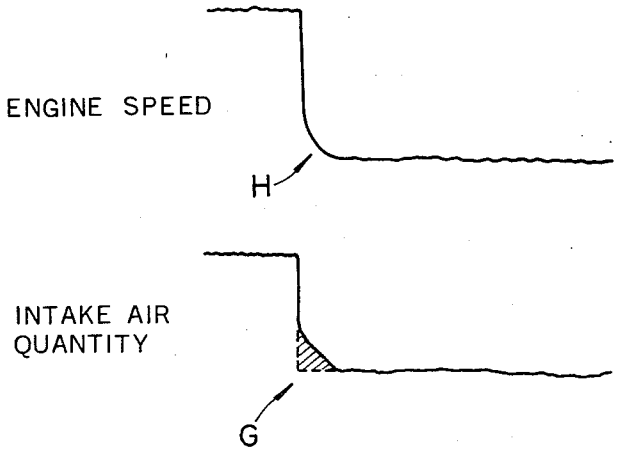

FIGS. 8*a* and 8*b* are explanatory drawings showing controlled result for explaining an effect of the present invention.

FIG. 8*a* is illustrated for the conventional idling speed control system and FIG. 8*b* for the preferred embodiment of the present invention.

As shown in FIG. 8*a*, there is an abrupt drop of the output engine speed at a point indicated by F. On the other hand, as shown in FIG. 8*b*, since the intake air flow quantity (manipulated variable) is gradually decreased as shown by a portion indicated by G, the engine speed has no abrupt drop at a point indicated by H. Consequently, the engine speed can drop smoothly and provide a stable speed thereafter.

As described hereinbefore, according to the present invention, a predetermined intake air quantity according to the engine speed is additionally supplied to the engine and descreased gradually to make the actual engine speed (N) approach the reference engine speed value ($N_{REF}$) at the instant when the control mode is transferred from the open-loop control to the feedback control and thereafter the control mode is switched to feedback control.

Consequently, in a case where an accelerator pedal linked with throttle valve is either depressed or released with the transmission gear in the neutral position or where the vehicle is decelerated from a considerably high speed range, there arises problems in the conventional system that the reduction of the engine speed is slower, or the controlled variable (engine speed) undershoots due to earlier switching to feedback control so that engine hunting or stalling occurs. However, such problems are solved by the idling speed control system according to the present invention.

Since, with the present system, engine stalling does not occur even when the reference speed value is set lower and since the stability of the engine is improved, the idling engine speed can be set lower so that the fuel consumption is remarkably reduced. As another preferred embodiment, the value of ALPHA may not always be outputted in the open-loop control mode and the adder 58 may add the value of ALPHA obtained from the table look-up immediately before the ALPHA LOOK-UP signal (L) becomes inactive (i.e., the FEEDBACK signal (H) becomes active) to the duty ratio so as to increase instantaneously the intake air flow quantity. Thereafter the value of ALPHA is decreased stepwise so as to decrease gradually the intake air flow quantity.

It will be fully understood by those skilled in the art that the foregoing description is in terms of preferred embodiments of the present invention wherein various changes and modifications may be made without departing from the sprit and scope of the present invention, which is to be defined by the appended claims.

What is claimed is:

1. An idling speed control system for an internal combustion engine of an automotive vehicle having intake air flow quantity control means located in an auxiliary passage beside an intake air passage, the control means actuated in response to a pulse signal with a calculated duty ratio, in which either feedback control or open-loop control is selectively carried out; in the mode of feedback control, the control operation being determined on a basis of actual engine speed and a reference engine speed so that a deviation of the actual engine speed from the reference engine speed is reduced substantially toward zero and in the mode of open-loop control, the control operation being determined on a basis of a cooling water temperature of the engine, the system comprising:

(a) a first means for determining the reference engine speed with respect to the cooling water temperature of the engine;

(b) a second means for discriminating engine operating conditions to determine when to perfrom feedback control and when to perform open-loop control;

(c) a third means for determining a basic duty ratio of a pulse signal outputted from the system on a basis of cooling water temperature, the basic duty ratio of the pulse signal being a basic control ratio of open-loop control and feedback control operations;

(d) a fourth means for determining a first correction value for combining with the basic duty ratio obtained from said third means on a basis of an actual engine speed and reference engine speed, said fourth means being operative after said second means determines to perform feedback control operation;

(e) a fifth means for determining a second correction value for combining with the basic duty ratio obtained from said third means on a basis of an actual engine speed and a reference engine speed;

(f) a sixth means for decreasing the second correction value gradually; and (g) a seventh means for additively combining the duty ratio obtained from said third, fourth and fifth means and outputting a pulse signal of a constant frequency and amplitude having the duty ratio obtained from said third, fourth and fifth means into the intake air quantity control means according to the control operation mode, whereby the output engine speed gradually nears the reference engine speed without overshooting so that the reference engine speed can be set lower and engine hunting and stalling can be prevented.

2. An idling speed control system for an internal combustion engine as set forth in claim 1, further comprising an eighth means for correcting the reference engine speed determined by said first means depending on whether a predetermined load is applied to the engine.

3. An idling speed control system for an internal combustion engine as set forth in claim 2, wherein said eighth means corrects the reference engine speed when an air conditioning device associated with the engine is turned on.

4. An idling speed control system for an internal combustion engine as set forth in claim 1, wherein said second means issues a feedback control command signal for indicating the determination of the feedback control of said fourth and fifth means when either of two feedback determining conditions is satisfied and otherwise issues an open-loop control command signal to said third means.

5. An idling speed control system for an internal combustion engine as set forth in claim 4, wherein conditions for feedback control are; a throttle valve located in an intake manifold of the engine is fully closed and a transmission gear linked with the engine is in a neutral position, or the throttle valve is fully closed and the speed of the automotive vehicle falls below 8 kilometers per hour regardless of the transmission gear position.

6. An idling speed control system for an internal combustion engine as set forth in claim 1, further comprising a ninth means for additively combining the basic duty ratio determined by said third means with a third correction value predetermined with respect to a correction coefficient for an air-fuel mixture supplied to a combustion chamber upon the start of the engine, said third correction value decreasing stepwise as the air-fuel mixture correction coefficient is reduced toward zero.

7. An idling speed control system for an internal combustion engine as set forth in claim 6, further comprising a tenth means for additively combining the basic duty ratio determined by said third means with a fourth correction value after said third correction value combined by said ninth means is reduced to zero when an air conditioning device is turned on.

8. An idling speed control system for an internal combustion engine as set forth in claim 1, further comprising an eleventh means for additively combining the basic duty ratio determined by said third means with a fifth correction value predetermined according to whether a valve of an air regulator located in an air passage between an intake air passage and intake manifold branch portion of the engine is opened or closed.

9. An idling speed control system for an internal combustion engine as set forth in claim 8, wherein said eleventh means additively combines said fifth correction value with the basic duty ratio before a throttle valve in an intake air passage is fully closed.

10. An idling speed control system for an internal combustion engine as set forth in claim 1, further comprising a twelfth means for additively combining the basic duty ratio with a sixth correction value predetermined according to the actual engine speed when the vehicle speed decreases from above 8 kilometers per hour with a transmission gear not in a neutral position and a throttle valve of an intake air passage fully closed, said sixth correction value decreasing stepwise toward zero whenever the engine has revolved a fixed number of revolutions and clearing to zero immediately before said second correction value determined by said fifth means is combined with the basic duty ratio.

11. An idling speed control system for an internal combustion engine as set forth in claim 1, wherein said fifth means performs arithmetic operations of the second correction value on a basis of current engine speed to be combined with the basic duty ratio and holds said correcting value until said second means determines to perform the feedback control operation, the second correction value initially taking a maximum value according to current engine speed and thereafter decreasing stepwise toward zero, in a substantially differential form, each time a fixed time interval is passed and wherein the correction operation of said fifth means is operative immediately after said circuit determines to perform feedback control operation.

12. An idling speed control system as set forth in claim 11, wherein said sixth means comprises a timer and the fixed time interval corresponds to a regular pulse outputted from said timer.

13. An idling speed control system for an internal combustion engine as set forth in claim 11, wherein said fourth means performs arithmetic operations on the first correction value and holds said value until said second circuit determines to perform the feedback control operation, the first correction value being an integral ratio corresponding to the deviation of the actual engine speed from the reference engine speed with respect to the duration at which the deviation is present for settling the actual engine speed at the reference engine speed when the actual engine speed is not within a dead zone.

14. An idling speed control system for an internal combustion engine as set forth in claim 13, wherein the dead zone is divided into two zones; a first dead zone being the reference engine speed less 25 revolutions per minute and a second dead zone being the reference engine speed plus 25 revolutions per minute.

15. An idling speed control system for an internal combustion engine as set forth in claim 14, wherein said fourth means calculates an integral ratio of said first correction value so that the integral ratio is subtractively combined with the basic duty ratio after the second correction value becomes zero and until the actual engine speed drops and arrives at the second dead zone and also calculates another integral ratio of the first correction value so that the integral ratio is additively combined with the basic duty ratio when the actual engine speed drops and exceeds the first dead zone regardless of the second correction value indicating zero.

16. An idling speed control system for an internal combustion engine as set forth in claim 12, wherein the first correction value calculated by said fourth means corresponds to a proportional ratio determined by the maximum and minimum limits of the dead zone when the actual engine speed drops and falls within the dead zone.

17. An idling speed control system for an internal combustion engine as set forth in claim 1, wherein said seventh means comprises an adder, connected to said third, fourth and fifth means, for outputting a duty ratio obtained by said third and fifth means in open-loop control mode and obtained by said third, fourth and fifth means in feedback control mode.

18. An idling speed control system for an internal combustion engine as set forth in claim 17, wherein said adder adds said second correction duty ratio to the basic duty ratio when obtained immediately before said second means determines to carry out feedback control so as to increase instantaneously the intake air quantity and thereafter said second correction duty ratio is decreased stepwise by said sixth means so as to decrease gradually the intake air quantity of the engine.

* * * * *